United States Patent [19]

Scala

[11] 4,378,084

[45] Mar. 29, 1983

[54] RELEASE MECHANISM FOR A RIVETING GUN COMPRISING AN OVERHEAD VALVE

[75] Inventor: Giancarlo Scala, Bologna, Italy

[73] Assignee: Fasco S.R.L., Cadriano, Italy

[21] Appl. No.: 174,334

[22] Filed: Aug. 1, 1980

[30] Foreign Application Priority Data

Aug. 9, 1979 [IT] Italy ..... 4909/79[U]

[51] Int. Cl.[3] ..... B25C 1/04

[52] U.S. Cl. ..... 227/8

[58] Field of Search ..... 227/8, 130

[56] References Cited

U.S. PATENT DOCUMENTS 3,580,455 5/1971 Cast et al. ..... 227/8
3,612,379 10/1971 Panock ..... 227/8
3,784,077 1/1974 Burke, Jr. et al. ..... 227/8
3,815,475 6/1974 Howard et al. ..... 227/130
4,252,261 2/1981 Klaus et al. ..... 227/130

FOREIGN PATENT DOCUMENTS 54-23274 2/1979 Japan ..... 227/8

*Primary Examiner*—John McQuade
*Attorney, Agent, or Firm*—Guido Modiano; Albert Josif

[57] ABSTRACT

In a release mechanism for compressed air guns an auxiliary trigger is provided, hinged to the gun main trigger and cooperating therewith in such a manner that, as the main trigger and the auxiliary trigger are pressed simultaneously, a plug member in a gun overhead valve is displaced to an intermediate position thereof to prevent the gun from resetting.

3 Claims, 3 Drawing Figures

RELEASE MECHANISM FOR A RIVETING GUN COMPRISING AN OVERHEAD VALVE

BACKGROUND OF THE INVENTION

This invention relates to a release mechanism for a riveting or nailing gun comprising an overhead valve.

Compressed air guns for firing metal nails or staples are known at the present time. These nailing guns are constituted generally by a hollow casing or head carrying a pneumatic cylinder in which a striking mass slides in order to cause rapid expulsion of the nails contained in a suitable magazine in the gun. Said striking mass is operated pneumatically by an overhead valve controlled by a trigger release mechanism. This trigger acts generally on the plug of a pilot valve associated with the overhead valve.

Safety reasons require that the pistol can only fire when in contact with the piece to be nailed. This is usually effected by means of a feeler which acts on a lever disposed between the trigger and pilot valve plug or pivoted to the trigger, so that if the lever is not moved by the feeler, the trigger rotates without engagement, and thus without moving the valve plug.

The drawbacks arising with known nailing guns mainly relate firstly to the return to the safety position after any individual shot, and secondly to the ability to carry out shots in succession under so-called repetition operation.

This second requirement is felt in particular by the more expert operators, who are thus able to carry out their work more rapidly.

SUMMARY OF THE INVENTION

The main object of the present invention is to provide a release mechanism which enables the nailing gun to be operated under either single shot or repetition conditions according to requirements, while always maintaining the necessary safety conditions.

This object is attained by a release mechanism for compressed air riveting or nailing guns comprising an overhead valve and a pilot valve which controls a duct for feeding compressed air to the overhead valve and comprises a valve plug mobile between three positions, namely a first gun activation position in which it connects the feed duct to a duct for discharge to atmosphere and closes the compressed air supply, a second gun resetting position in which it connects the feed duct to a compressed air supply and closes the discharge duct, and a third gun neutralisation position, intermediate between the preceding, in which the valve plug closes the discharge duct and compressed air supply, said mechanism also comprising a feeler supported mobile in the gun and able to undergo a movement stroke when the gun is rested on a piece to be nailed, a main trigger hinged to said gun, and a lever hinged in said main trigger in such a manner as to act on the valve plug and be controllable by the feeler, the movement of the valve plug by the lever being determined by the combined operation of the main trigger and feeler, characterized in that it comprises an auxiliary trigger hinged in the main trigger and cooperating with said lever in such a manner that when the main trigger and auxiliary trigger are pressed simultaneously, the lever causes the valve plug to move to its intermediate position and prevents the resetting of the gun.

BRIEF DESCRIPTION OF THE DRAWINGS

The characteristics of the present invention will be more apparent from the detailed description of a preferred embodiment of the riveting or nailing gun release mechanism illustrated by way of example on the accompanying drawings, in which.

DESCRIPTION OF THE PREFERRED EMBODIMENTS

Figure 1:
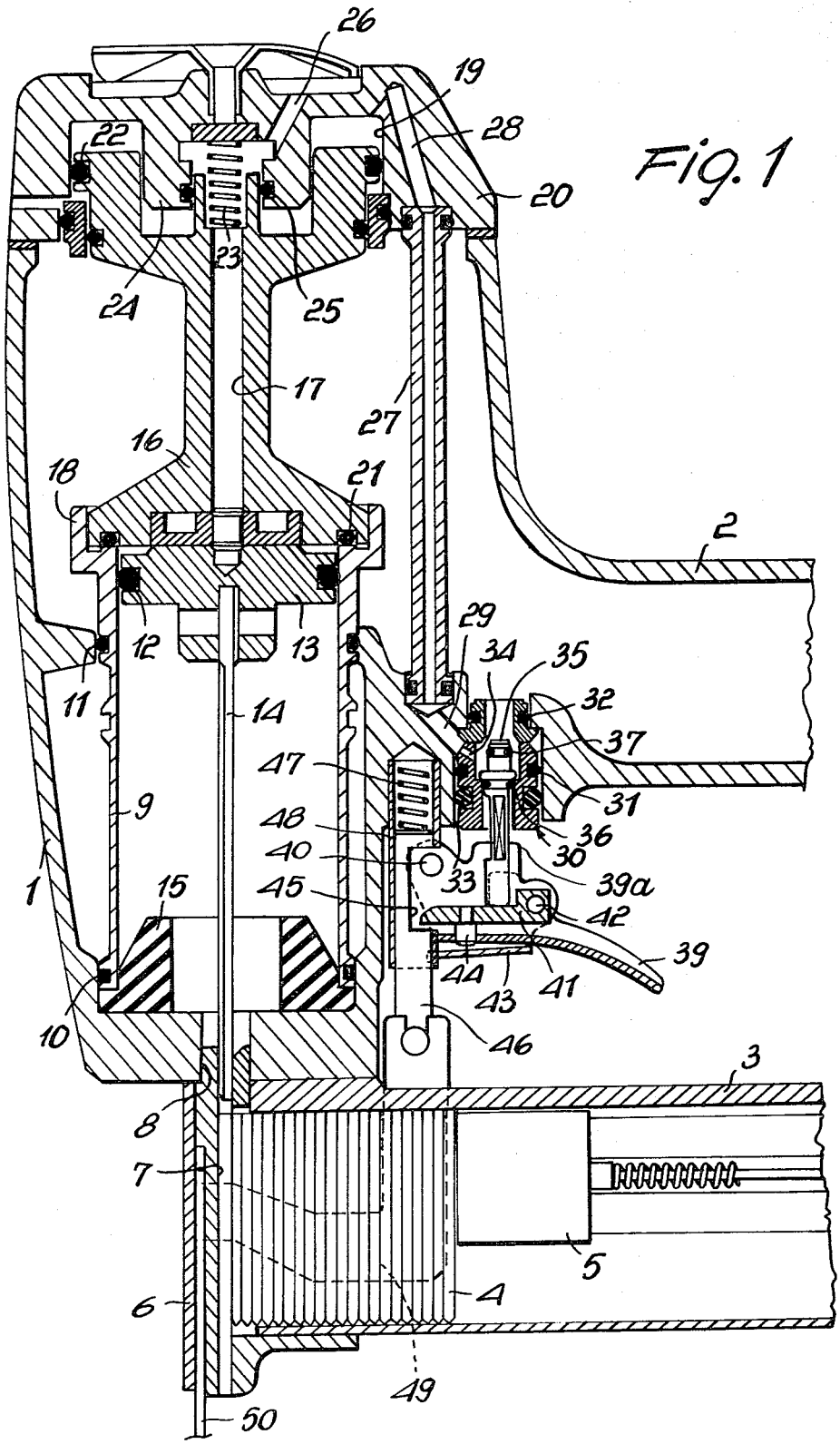
FIG. 1 is a longitudinal section through the riveting or nailing gun according to the invention.

In said Figures, the reference numeral 1 indicates the known head of a nailing gun comprising an overhead valve, constituted by a generally cylindrical casing and provided with a grip 2 orthogonal to said casing which is equally hollow for feeding through its compressed air for operating the gun.

A magazine 3 is orthogonally rigid with the front end of the casing 1 to contain nails or staples 4 of T or U shape disposed in a row in its interior and kept compact by a spring pusher 5. The magazine 3 is closed at its front by an end head piece 6 provided with a nail exit channel 7, this channel being aligned with an axial bore 8 in the head 1.

A cylindrical barrel 9 is inserted axially into the front portion of the head 1 and is sealed against the inner surface of the head by gaskets 10, 11. A striking mass 13 is slidable in the barrel 9 under sealed conditions by way of a gasket 12, and has fixed to it a blade 14 which being coaxial to the barrel 9 can expel the nails 4 on being inserted into the channel 7 through the bore 8.

An annular rubber pad 15 is disposed between the casing 1 and barrel 9, in front of the front end of this latter, in order to act as a limit stop for the striking mass 13. The other end of the barrel 9 is closed by the valve 16, which is why the nailing gun of the overhead valve type is so-called. The valve 16 is substantially in the shape of a spool which, provided with an axial bore 17, is disposed coaxial to the cylindrical barrel 9 and comprises at its opposing ends cylindrical expansions which are guided at one end in a widened portion 18 of the barrel 9, and at the other end in a compartment 19 of a cover 20 for the head 1. Gaskets 21,22 provide the seal against the barrel and cover respectively.

The valve 16 is axially slidable against a spiral spring 23 which rests against the cover 20 and urges the valve against the barrel 9. An annular enlargement 24 on the cover 20 isolates the bore 17 of the valve 16 from the compartment 19 of the head 1 by way of a seal provided by a gasket 25. Said bore is in communication with the outside through a vent 26 in the cover.

Below the valve 16, the head 1 is traversed longitudinally by a tube 27 which is in communication at one end with a duct 28 provided in the cover 20 and leading to the compartment 19, and at the other end with a duct 29 provided in the casing of the head 1 and leading to a pilot valve 30.

The pilot valve 30 is constituted by a suitably shaped tubular body formed for constructional reasons as two half-bodies, and is inserted with its axis parallel to the longitudinal axis of the head 1 into a suitable through seat in the head casing, below the grip 2. The pilot valve 30 is sealed in this casing by gaskets 31, 32, and is fixed axially to it by a pin 33. Bores 34 connect the central portion of the valve cavity with the duct 29.

Figure 2:
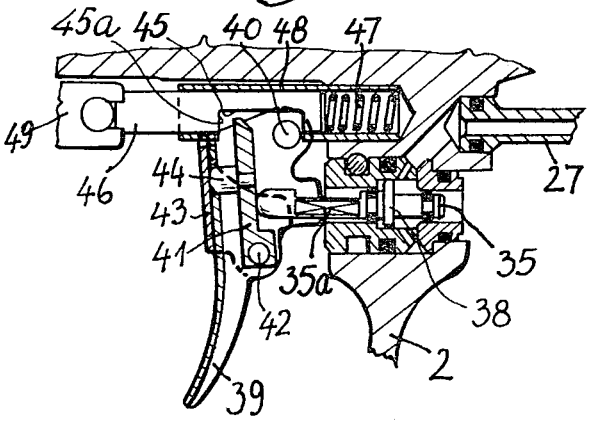
FIG. 2 is a section through the release mechanism in its operating position.
Figure 3:
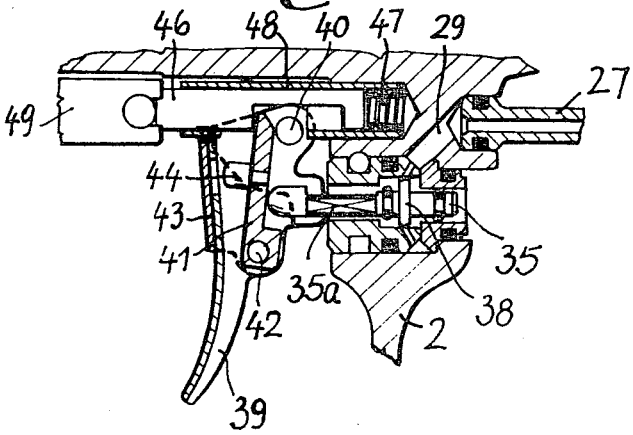
FIG. 3 shows the release mechanism in its operated position after a single release.

A valve plug 35 fitted with seal rings 36, 37 and a stop collar 38 is slidably mounted in the pilot valve 30 (FIGS. 2 and 3). The bottom end of the valve plug emerges into the open where the release mechanism is disposed in order to control its movement. This release mechanism comprises a first or main trigger 39 mounted rotatably about a pin 40 which has its axis orthogonal to the axis of the head 1.

The main trigger 39 is formed from a metal element of U shape, in which is pivoted a lever 41 rotatable about a pin 42 parallel to the trigger pin 40. The lever 41 faces the head 1, and is disposed between the trigger 39 and the plug 35 of the pilot valve 30. The trigger 39 comprises a projection 39*a* which when the trigger is pulled rests against the valve 30, before causing the valve plug to be moved by the lever 41.

An auxiliary trigger 43 is also mounted on the pin 42, and is disposed straddling the main trigger 39 and extending also towards the gun head. The auxiliary trigger 43 is arranged to act on a pin 44 rigid with the front of the lever 41 and projecting downwards through a slot in the main trigger 39.

The free end of the lever 41 engages in a cavity 45 of a rod 46 mounted slidable against a spring 47 in a bush 48 fixed longitudinally to the casing of the gun head 1. A suitable aperture is provided in said bush 48 at the cavity 45 in the rod, for the insertion of the lever 41.

The movement of the rod 46 is controlled, by way of a transmission element 49, by a known feeler 50 which is guided in the head 6 and moves when rested on the surface to be nailed.

The operation of the described release mechanism is as follows.

Having connected the nailing gun to the compressed air supply line, the cavity in the head 1 is pressurized, and the compartment 19 between the head valve 16 and cover 20 also becomes pressurized by way of the pilot valve 30 and tube 27. The effect of this pressure and the thrust of the spring 23 is that the valve is kept frontally in contact with the barrel 9, so isolating the interior of this latter from the pressure.

When the gun does not rest on the piece to be nailed, operation of the trigger 39, i.e. its rotation about the pin 40, has no effect as it is not able to move the plug 35 of the pilot valve 30, so providing the necessary safety.

On the contrary the nailing gun is made able to operate when the head 6 is rested against the surface to be nailed. In fact, when this happens, the feeler 50 retracts, and against the spring 47 causes the rod 46 to move, with the result that its ledge 45*a* engages with the lever 41.

Rotation of this lever about the pin 42 causes it to approach the valve plug 35, so setting it for operation.

It is then possible to choose between two different types of operation, namely either a single shot operation, or repetition operation, comprising multiple shots in succession.

To carry out the single shot, the main trigger 39 and auxiliary trigger 43 are operated simultaneously, to cause the valve plug 35 to make a partial slide movement (FIG. 2).

The feeler 50 is then rested on the piece to complete the stroke (FIG. 3), by which the ring 37 closes the compressed air feed to the pilot valve 30. The discharge is simultaneously opened, so that pressure is removed from the head valve 16 through the tube 27. In order to make this discharge more rapid, the valve plug is provided on its outer portion with facets. With the pressure on its rear face released, the valve 16 moves against the cover 20, to allow compressed air to pass into the barrel 9, the striking mass 13 of which is therefore projected with force against the pad 15. The blade 14 thus expels a nail 4 from the channel 7 of the gun.

As the gun separates from the surface to be nailed due to the backward reaction to the blow, and if the triggers 39 and 43 are kept pressed, the valve plug makes a partial return stroke under the thrust of the pressure in the head 1, to the extent allowed by the rotation of the lever 41 which, being no longer engaged by the rod 46, abuts, by means of its pin 44, against the auxiliary trigger 43 as shown in FIG. 2.

In this manner, the seal ring 36 closes the air discharge port of the pilot valve 30, the feed port being still closed by the gasket 37: in this way it is not possible to return the valve 16 so that it closes the barrel 9.

If the gun is again rested on the surface to be nailed, the valve plug is caused to make the remaining part of its stroke by the effect of the rotation of the lever 41, to determine reopening of the discharge port (position of FIG. 3), but not the firing of a second nail as the valve 16 has remained open. For a repeating type of operation, only the trigger 39 is operated. In this respect, after resting the gun on the piece, the operation of the trigger completes the stroke of the valve plug 35, to cause the valve 16 to open. When the gun separates from the piece being nailed, the valve plug makes its complete return stroke if the main trigger 39 is kept pressed (position of FIG. 1), so that the lever 41 is no longer locked by the auxiliary trigger 43. The discharge port in the pilot valve 30 is therefore closed, and its compressed air feed port is open so that the compartment 19 is put under pressure to return the valve 16 into contact with the barrel 9. The upper chamber of the barrel 9 is discharged through the bore 17 of the valve 16 and the vent 26, so enabling the striking mass 13 to be reset by the feed of compressed air into the chamber below the striking mass 13. The ducts for this purpose are not shown on the drawing as they are known.

When the gun is again rested on the surface to be nailed, the rod 46 again acts on the lever 41, so that if the trigger 39 is kept pressed, a new shot is fired. It is apparent that the invention perfectly attains the said objects. In particular, any accidental firing of a second shot due to recoil is prevented when the gun is set for single shots.

I claim:

1. A release mechanism for compressed air riveting or nailing guns comprising an overhead valve and a pilot valve which controls a duct for feeding compressed air to the overhead valve and comprises a valve plug mobile between three positions, namely a first gun activation position in which it connects the feed duct to a duct for discharge to atmosphere and closes the compressed air supply, a second gun resetting position in which it connects the feed duct to a compressed air supply and closes the discharge duct, and a third gun neutralization position, intermediate between the preceding, in which the valve plug closes the discharge duct and compressed air supply, said mechanism also comprising a feeler supported mobile in the gun and able to undergo a movement stroke when the gun is rested on a piece to be nailed, a main trigger hinged to said gun, and a lever hinged in said main trigger in such a manner as to act on the valve plug and be controllable by the feeler, movement of the valve plug by the lever being determined by the combined operation of the main trigger and feeler, characterized in that the release mechanism comprises an auxiliary trigger hinged in the main trigger and cooperating with said lever in such a manner that when the main trigger and auxiliary trigger are pressed simultaneously, the lever causes the valve plug to move into its intermediate position and prevents the resetting of the gun.

2. A mechanism as claimed in claim 1, characterized in that said auxiliary trigger is mounted straddling the main trigger, and is hinged on the same hinging axis as said lever.

3. A mechanism as claimed in claim 2, characterized in that the lever is provided with a pin which passes through a slot in the main trigger, and on which the auxiliary trigger acts.

* * * * *